United States Patent [19]

Evans

[11] Patent Number: 4,821,041

[45] Date of Patent: Apr. 11, 1989

[54] PATCH ANTENNA

[75] Inventor: David H. Evans, Crawley, England

[73] Assignee: U.S. Philips Corporation, New York, N.Y.

[21] Appl. No.: 134,428

[22] Filed: Dec. 17, 1987

[30] Foreign Application Priority Data

Dec. 22, 1986 [GB] United Kingdom ..... 8630599

[51] Int. Cl.[4] ..... H01Q 00/00

[52] U.S. Cl. ..... 343/700 MS; 343/745; 343/750

[58] Field of Search ..... 343/700 M S, 745, 746, 343/750

[56] References Cited

U.S. PATENT DOCUMENTS 4,047,181 9/1977 Hoople ..... 343/789

*Primary Examiner*—William L. Sikes

*Assistant Examiner*—Robert E. Wise

*Attorney, Agent, or Firm*—Robert J. Kraus

[57] ABSTRACT

A microwave patch antenna, comprising a substrate of high dielectric constant, an aperture in the substrate, a patch conductor positioned on one side of the conductor and juxtaposed over said aperture, a ground plane on the other side of the substrate and having an aperture juxtaposed to at least a substantial proportion of the patch conductor. A conductive cavity is RF-coupled to the ground plane at the aperture, the cavity extending away from the substrate and being short-circuited at its end remote therefrom; in the operating frequency range of the antenna, the cavity forms a waveguide constituting an inductance. The length of the cavity may be adjustable to tune the antenna, the length of the cavity being sufficient for the resonant frequency of the antenna to decrease with increasing cavity length.

6 Claims, 3 Drawing Sheets

PATCH ANTENNA

BACKGROUND OF THE INVENTION

The invention relates to a patch antenna for use at microwave wavelengths. (The term "microwave wavelengths" is to be understood to include millimeter wavelengths.)

Microstrip patch antennae are well known. They typically comprise a dielectric substrate with a ground plane on one major surface and, on the other major surface, a strip conductor which provides a feed and which is connected to a broader conductive area known as a patch. The length of the patch (in the direction of the feed) is slightly less than half a wavelength at the operating frequency; the width of the patch may be chosen to provide a suitable radiation resistance.

A suspended patch antenna, in which the patch is supported on a dielectric substrate parallel to and spaced from the ground plane, is also known: see "Analysis of a Suspended Patch Antenna Excited by an Electromagnetically Coupled Inverted Microstrip Feed" by Qiu Zhang et al., Proc. 14th European Microwave Conf., 1984, pages 613–618. Such an arrangement provides the advantages of increased efficiency and bandwidth (see also "Electromagnetically Coupled Microstrip Dipole Antenna Elements" by H. G. Oltman, Proc. 8th European Microwave Conf., 1978, pages 281–285).

SUMMARY OF THE INVENTION

According to a first aspect of the invention, there is provided a patch antenna characterised by:

a dielectric substrate, a patch conductor and feeding means on one major surface of the substrate, and a ground plane on the side of the substrate remote from said one major surface, the ground plane having a conductive cavity which is juxtaposed to at least a substantial proportion of the patch conductor and which extends away from the substrate and is short-circuited at its end remote from the substrate, wherein in the operating frequency range of the antenna, the cavity cooperates with the patch conductor to form a waveguide constituting an inductance.

Such an antenna provides an alternative configuration to the known suspended patch antenna while providing advntages of somewhat improved efficiency and greater bandwidth (over which the return loss is better than a given value) in comparison with a coventional microstrip patch antenna.

Preferably, the length of the cavity is adjustable whereby to tune the antenna.

According to a second aspect of the invention, there is provided a patch antenna characterised by:

a dielectric substrate, a patch conductor and feeding means on one major surface of the substrate, and a ground plane on the side of the substrate remote from said one major surface, the ground plane having a conductive cavity which is juxtaposed to at least a substantial proportion of the patch conductor, and which extends away from the substrate and is short-circuited at its end remote from the substrate, the length of the cavity being adjustable, wherein in an operating frequency range of the antenna, the length of the cavity is such that the resonant frequency of the antenna decreases with increasing cavity length.

Tuning arrangements for microstrip transmission lines are known. GB No. 1 515 151 discloses (see particularly the second embodiment, described with reference to FIGS. 3 and 4) a microstrip line on a substrate mounted on a conductive carrier, with an aperture in the ground plane and the carrier, the aperture being juxtaposed to the strip conductor; the aperture in the carrier is threaded and receives a screw. According to the specification, as the screw is moved in and out of the carrier, the flux path to ground from the microstrip transmission line above the screw is shortened and lengthened; this changes the capacitance of the microstrip transmission line immediately above the screw and hence the characteristic impedance of the microstrip transmission line. There is no suggestion that the space between the substrate and the screw can act as a waveguide cavity (the threaded wall would indeed inhibit this) or that it can provide an inductance. Moreover, if such an arrangement were to be used with a patch antenna, one would expect the change in spacing between the microstrip line and the effective ground plane provided by the end of the screw to result in the resonant frequency of the antenna increasing with the spacing.

U.S. Pat. No. 3,693,188 discloses a tuning arrangement for a strip transmission line circuit in which a substrate carrying a microstrip line is similarly mounted on a metal bar. A channel is provided in the bar, extending immediately beneath a strip conductor (in this case a stub) of the microstrip line; a metal member is slidable in the channel, in a direction parallel to the substrate, between a first position in which the member substantially occludes the region of the substrate extending over the channel and a second position in which it does not cover any of this region. According to the specification, the characteristic impedance is higher when the metal member is in the second position than when it is in the first position; the microstrip stub is effectively electrically shortened. If the removed portion of the ground plane is selectively restored by moving the metal member, a variable reactance element is obtained. This variation in reactance is apparently due to the change in characteristic impedance and effective electrical length of the stub, thus varying the reactance presented by the stub. There is no suggestion that a waveguide cavity providing an inductance is formed. Furthermore, whereas an oscillator including the tuning arrangement of the U.S. patent was tuned over the frequency range of 10 GHz to 11 GHz (i.e. slightly less than 10% of the mid-range frequency), a patch antenna embodying the present invention, wherein a short-circuit is movable towards and away from the substrate rather than parallel to it, was found to be tunable over a frequency range of 19.0 GHz to 24.4 GHz (i.e. 25% of the mid-range frequency).

In an antenna embodying the invention, the waveguide formed by the cavity may have a cut-off frequency above the operating frequency range of the antenna. In that case, the waveguide functions in the evanescent mode in the operating frequency range, always constituting an inductance as the length of the cavity is adjusted, whereas if the operating frequency is above the cut-off frequency, the reactance presented by the waveguide alterates between an inductance and a capacitance as the length of the cavity is adjusted (if there is a sufficient large range of adjustment).

The projection of the patch conductor parallel to itself may lie substantially wholly within the cavity. This results in the cavity not having a substantially asymmetrical effect on the radiation pattern of the patch, as might otherwise occur.

The invention is suited to a patch antenna on a substrate of high dielectric constant, for example not substantially less than 9. Patch antennae formed on high dielectric constant substrates tend to have particularly low efficiencies; the increase in efficiency provided by the cavity in an antenna embodying the invention is especially desirable.

BRIEF DESCRIPTION OF THE DRAWING

An embodiment of the invention will now be described, by way of example, with reference to the diagrammatic drawing figures, in which.

DESCRIPTION OF THE PREFERRED EMBODIMENT

Figure 1:
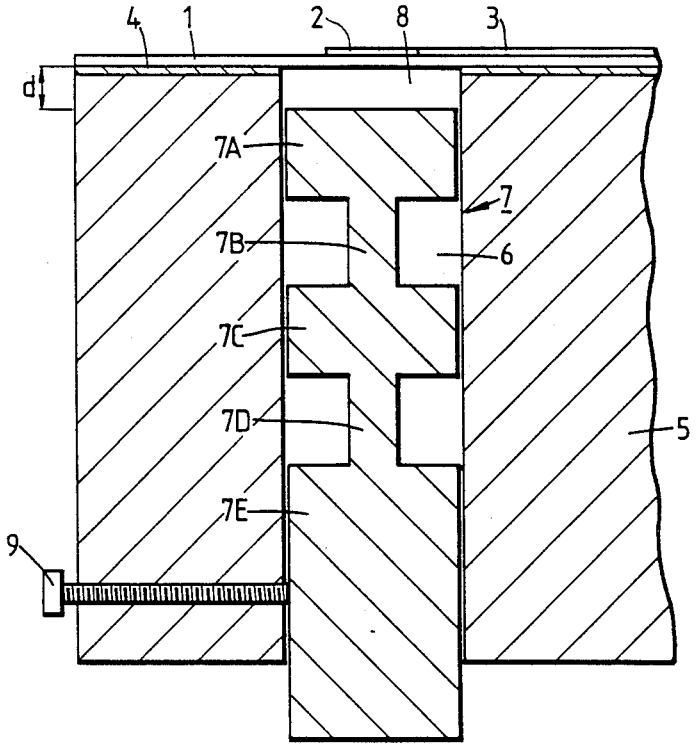
FIG. 1 is a side view, partly in cross-section, of an experimental patch antenna assembly embodying the invention.
Figure 2:
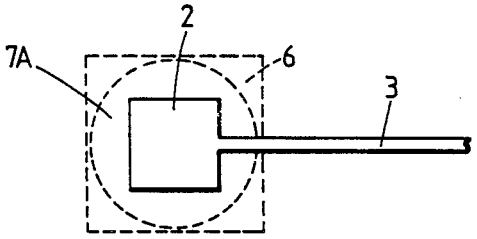
FIG. 2 is a plan view of the patch conductor and feed line in the assembly of FIG. 1, also indicating the cavity and slidable short-circuit.

Referring to FIGS. 1 and 2, a patch antenna assembly comprises a dielectric substrate 1 supporting on one major surface a relatively broad rectangular or substantially square patch conductor 2 connected to a relatively narrow feed conductor 3. On the opposite major surface of the substrate is a conductive ground plane 4 which in turn is conductively bonded to a metal block 5. In this block is an aperture 6 of square cross-section extending through the block, the aperture 6 being aligned with an aperture of the same cross-section in the ground plane. The aperture is in this case juxtaposed to the whole of the patch conductor, the centre of the patch conductor lying on the axis of the aperture and the side of the square aperture being longer than each side of the rectangular or square patch conductor; the projection of the patch conductor parallel to itself thus lies wholly within the aperture.

The aperture 6 receives a slidable short-circuit 7 of circular cross-section, comprising alternate quarter-wave portions of relatively low impedance (7A, 7C, 7E) and relatively high impedance (7B, 7D). The portion of the aperture 6 between the substrate 1 and the adjacent end of the short-circuit 7 (said end constituting the short-circuit termination) may act as a waveguide cavity 8, as will be explained further below. The slidable short-circuit can be clamped in position by a screw 9 (depicted diagrammatically).

In operation, microwave energy can be supplied to or be extracted from the patch conductor 2 via the feed conductor 3 which may, for example, be connected to a microstrip/coaxial line mode transducer (not shown). The resonant frequency of the antenna may be ascertained by supplying energy to the antenna and measuring the variation in return loss with frequency: at the resonant frequency, there is an increase in return loss.

Figure 3:
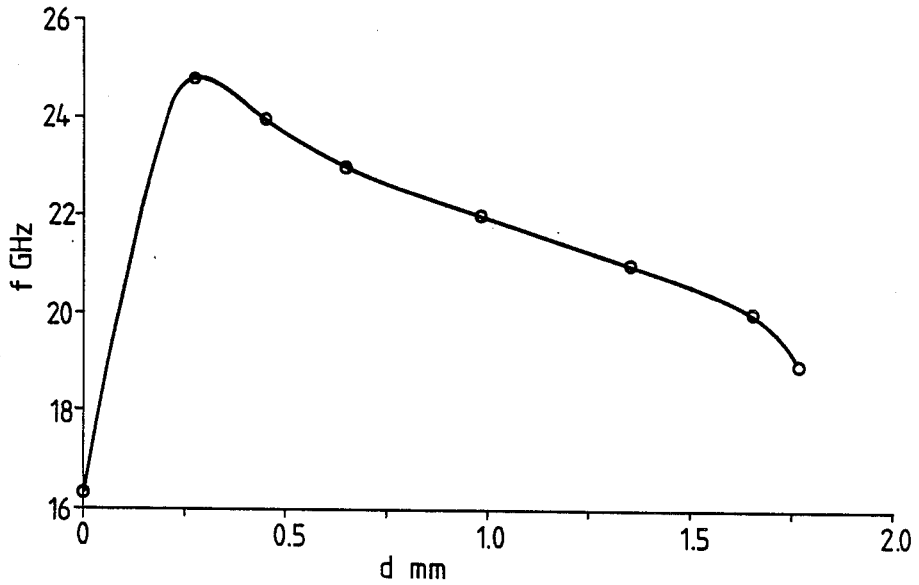
FIG. 3 is a graph showing the measured variation of the resonant frequency of the antenna with the position of the short-circuit in a constructed antenna.

FIG. 3 is a graph of resonant frequency f(in GHz) against the distance d (in mm) between the substrate and the slidable short-circuit, as measured on a constructed embodiment of the form of FIGS. 1 and 2. When d is zero, the antenna operates substantially as a conventional microstrip patch antenna. As the distance d is increased from zero, the resonant frequency initially increases very rapidly to a maximum value (for simplicity, the increase has been depicted in FIG. 3 as predominantly linear). In this region, the antenna is believed to be operating substantially as a suspended stripline patch antenna, the increase in the distance d lowering the effective dielectric constant of the matter between the patch and the ground plane (the latter being formed by the short-circuit 7); the return loss improves in comparison with its value at $d=0$, and the instantaneous bandwidth increases.

Beyond the maximum, the frequency f decreases, but the rate of change of f with d is much lower than in the initial increase, making it practicable to mechanically tune the antenna fairly precisely; it is believed that in this region, the distance d is sufficient for the space between the substrate and the slidable short-circuit to act as a waveguide cavity. In the constructed embodiment, th cut-off frequency of the aperture 6 was just above the maximum value of the resonant frequency, and hence the cavity would always constitute an inductance in the operating frequency range of the antenna. If the resonant frequency were above cut-off, the waveguide cavity would constitute an inductance for lengths up to a quarter-wavelength, a capacitance between a quarter and half a wavelength, etc.; in practice, the length would typically be less than a quarter of a wavelength. It is the increasing inductance as d increases beyond the maximum of the tuning characteristic that is believed to result in the decreasing resonant frequency.

As indicated in FIG. 3, the constructed embodiment was tunable, in the region of the characteristic in which f decreases with increasing d, over a range of 19.0–24.4 GHz, i.e. 25% of the mid-range frequency. Over a significant portion of this region of the tuning characteristic, the characteristic was approximately linear. Around 21.5 GHz, the instantaneous bandwidth was 1.6 GHz for a return loss no less than 6 dB (a VSWR of 3:1).

In the constructed embodiment, the patch conductor was 3 mm square and the aperture 6 was 6 mm square. The substrate had a dielectric constant of 10.5. The block 5 was of brass.

Figure 4:
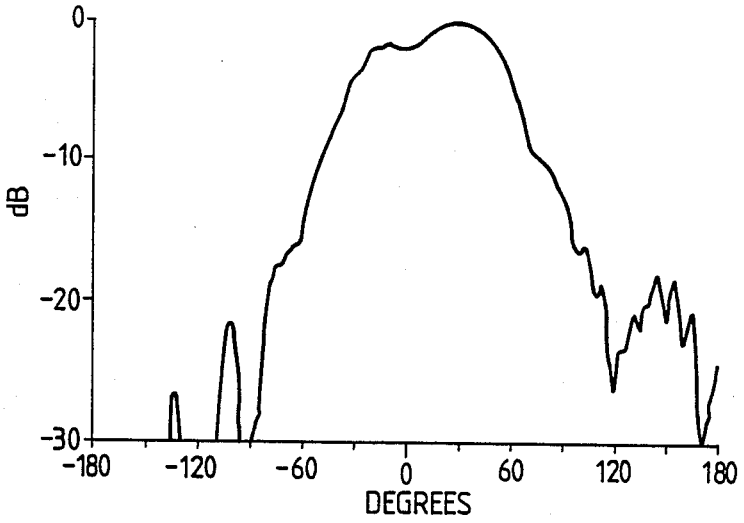
FIGS. 4 and 5 are respectively the E-plane and H-plane radiation patterns of the antenna.
Figure 5:
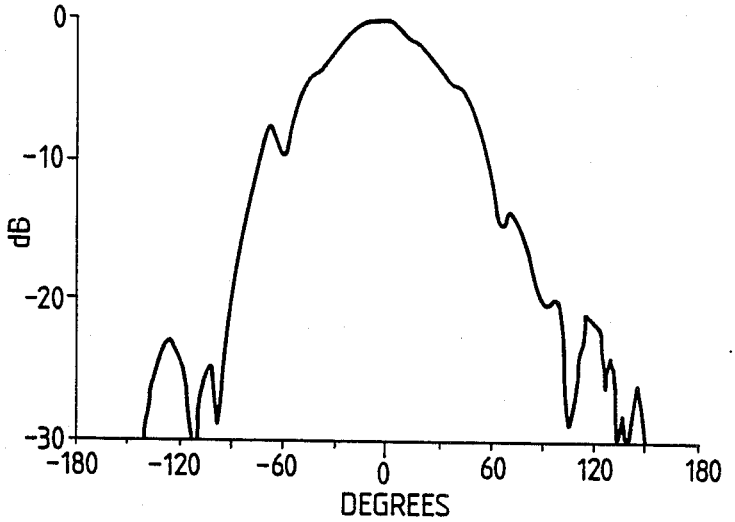

FIGS. 4 and 5 are respectively the E-plane and the H-plane radiation patterns of the constructed antenna, showing the antenna response in dB relative to maximum against angle to the normal to the patch conductor in degrees. The patterns are typical for a patch antenna on a high dielectric constant substrate.

In an antenna embodying the invention, the ground plane need not be directly on the dielectric substrate supporting the patch conductor; for example, the ground plane may be spaced from the substrate as in a suspended substrate line.

I claim:

1. A patch antenna comprising:

a. a dielectric substrate having first and second surfaces on opposite sides thereof;

b. a patch conductor and feeding means therefor disposed at the first surface;

c. a ground plane conductor disposed at the second surface and having an aperture therein juxtaposed to at least a substantial proportion of the patch conductor; and d. a conductive element electrically connected to the ground plane and including a cavity therein having one end adjacent the ground plane aperture and having an opposite end defined by a conductive surface forming a short circuit termination of the cavity, said short circuit termination being spaced from the substrate by a distance d which effects operation of the cavity as a waveguide having an inductive impedance.

2. A patch antenna as in claim 1 where the conductive surface forming the short circuit termination is movable to enable adjustment of the distance d.

3. A patch antenna comprising:

a. a dielectric substrate having first and second surfaces on opposite sides thereof;

b. a patch conductor and feeding means therefor disposed at the first surface;

c. a ground plane conductor disposed at the second surface and having an aperture therein juxtaposed to at least a substantial proportion of the patch conductor; and d. a conductive element electrically connected to the ground plane and including a cavity therein having one end adjacent the ground plane aperture and having an opposite end defined by a conductive surface forming a short circuit termination of the cavity, the distance d of said short circuit termination from the substrate being adjustable over a range for which the resonant frequency of the antenna decreases with increasing distance d.

4. A patch antenna as in claim 1, 2 or 3 where the cavity has a cutoff frequency above the operating frequency range of the antenna.

5. The antenna as in claim 1, 2 or 3 where a projection of the end of the cavity adjacent the ground plane surrounds the patch conductor.

6. An antenna as in claim 1, 2 or 3 where the substrate has a dielectric constant which is not less than 9.

* * * * *